US007319772B2

(12) United States Patent
Chang

(10) Patent No.: US 7,319,772 B2
(45) Date of Patent: Jan. 15, 2008

(54) SPEAKER DEVICE FOR IMPROVING MID/HIGH-RANGE FREQUENCIES

(76) Inventor: George Chang, No. 191, Ta-Chih Rd., Niao-Sung Hsiang, Kaohsiung Hsien (TW)

( * ) Notice: Subject to any disclaimer, the term of this patent is extended or adjusted under 35 U.S.C. 154(b) by 478 days.

(21) Appl. No.: 11/030,766

(22) Filed: Jan. 7, 2005

(65) Prior Publication Data

US 2006/0153412 A1 Jul. 13, 2006

(51) Int. Cl.
*H04R 9/00* (2006.01)
*H04R 3/00* (2006.01)
*H04R 7/00* (2006.01)

(52) U.S. Cl. ..... 381/343; 381/398; 381/423; 381/432; 381/396; 381/337; 181/151; 181/152; 181/166; 181/171

(58) Field of Classification Search ..... 381/340–343, 381/398, 401, 423, 424, 430, 432, 182, 184, 381/186, 396; 181/156, 152, 163–165, 171–173
See application file for complete search history.

(56) References Cited

U.S. PATENT DOCUMENTS 3,665,124 A * 5/1972 Sotome ..... 381/401
5,602,930 A * 2/1997 Walton ..... 381/396
5,739,480 A * 4/1998 Lin ..... 181/144
5,742,696 A * 4/1998 Walton ..... 381/340
6,026,928 A * 2/2000 Maharaj ..... 181/152
6,320,970 B1 * 11/2001 Czerwinski et al. ..... 381/343
6,650,760 B1 * 11/2003 Andrews et al. ..... 381/343
7,185,735 B2 * 3/2007 Sahyoun ..... 181/157

OTHER PUBLICATIONS

U.S. Appl. No. 10/829,941, filed Apr. 18, 2006.

* cited by examiner

*Primary Examiner*—Wayne Young
*Assistant Examiner*—Dionne Pendleton
(74) *Attorney, Agent, or Firm*—Alan Kamrath; Kamrath & Associates PA

(57) ABSTRACT

A speaker device for improving mid/high-range frequencies includes a magnetic base, a frame annularly mounted to the magnetic base, a cone mounted to an inner side of the frame, a voice coil mounted to the cone and suspended in a gap of the magnetic base, and a deadening phase plug mounted on a central portion of the magnetic base. The magnetic base includes a T-iron, a magnet, and a pole plate. The deadening phase plug is made of a sound-absorbing material for absorbing and eliminating sound waves generated by the voice coil and the cone.

5 Claims, 5 Drawing Sheets

SPEAKER DEVICE FOR IMPROVING MID/HIGH-RANGE FREQUENCIES

BACKGROUND OF THE INVENTION

1. Field of the Invention

The present invention relates to a speaker device for improving mid/high-range frequencies. In particular, the present invention relates to a speaker including a deadening phase plug made of sound-absorbing material for absorbing interference of sound waves.

2. Description of Related Art

U.S. Pat. No. 7,031,488 discloses a tweeter comprising a T-iron, a cone (or diaphragm), a voice coil, and a phase plug. The T-iron includes a central protruded portion on which the phase plug is mounted. The distal end of the phase plug tapers to a conic or bullet-head shape and is made of metal or plastic material. The voice coil is suspended in a gap surrounding the T-iron. When vibrational energy generated by the voice coil is transmitted to the cone, the vibrational energy is transformed by the cone into sound waves that are emitted outward. At this time, the phase plug prevents mutual interference of sound waves and suppresses chaos in mid/high range frequencies of sound waves, thereby reducing deficiency in sound quality and improving vibrational characteristics in the mid/high range frequencies of sound waves.

However, the effect which the phase plug made of metal or plastic material prevents the interference of sound wave was found unsatisfactory. The deficiency in sound quality was not actually solved. As a result, the sound quality and characteristics of the tweeter were adversely affected.

OBJECT OF THE INVENTION

An object of the present invention is to provide a speaker device including a deadening phase plug that is made of a sound-absorbing material for effectively absorbing interference of sound waves, thereby reducing deficiency in sound quality, improving vibrational characteristics, and producing excellent sound quality.

SUMMARY OF THE INVENTION

In accordance with the present invention, a speaker device comprises a magnetic base, a frame annularly mounted to the magnetic base, a cone mounted to an inner side of the frame, a voice coil mounted to the cone and suspended in a gap of the magnetic base, and a deadening phase plug mounted on a central portion of the magnetic base. The magnetic base comprises a T-iron, a magnet, and a pole plate. The deadening phase plug is made of a sound-absorbing material for absorbing and eliminating the interference of sound waves generated by the voice coil and the cone.

Preferably, the deadening phase plug comprises a distal end that tapers to one of a conic shape, a bullet-head shape, and an arcuate shape.

Preferably, the sound-absorbing material is sound-absorbing cotton or wool felt.

Preferably, the T-iron includes a chassis on the central portion thereof, and the deadening phase plug is mounted on the chassis. The gap is defined between the T-iron and the magnet as well as the pole plate.

In an embodiment of the invention, the midrange device further comprises a damper mounted between the voice coil and the frame for maintaining vibrational balance of the voice coil.

The midrange device further comprises a supporting member for connecting the cone to the frame. The cone includes a central hole, and the voice coil is mounted to an inner periphery delimiting the central hole of the cone.

In another embodiment of the invention, the tweeter device further comprises a connecting member mounted on the chassis, and the deadening phase plug is mounted on the connecting member. The tweeter further comprises an outer annular supporting member for connecting an outer side of the cone to the frame. The tweeter further comprises an inner annular supporting member having an outer end fixed to an inner side of the cone and an inner end sandwiched between the chassis and the connecting member.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
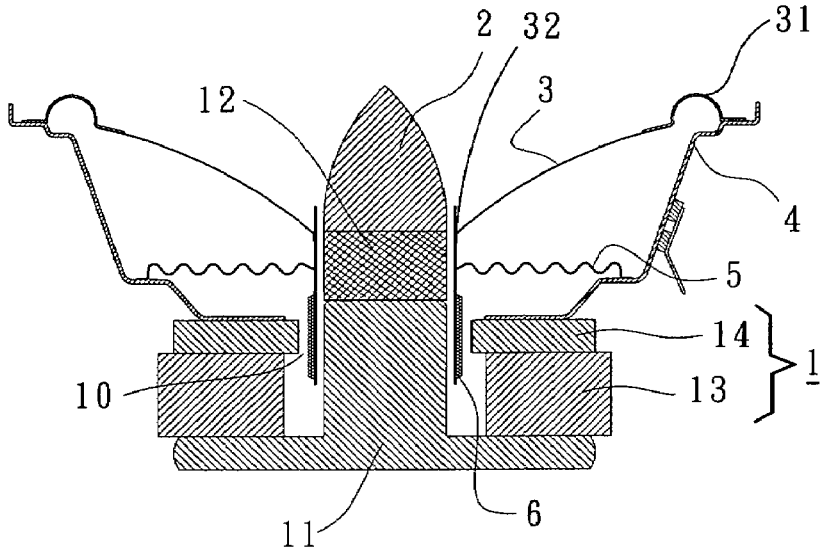
FIG. 1 is a sectional view of a first embodiment of a midrange device for improving mid-range frequencies in accordance with the present invention.

Referring to FIG. 1, the first embodiment of a midrange device for improving mid-range frequencies in accordance with the present invention includes a magnetic base 1, a deadening phase plug 2, a cone 3, a frame 4, a damper 5, and a voice coil 6.

Still referring to FIG. 1, the magnetic base 1 includes a T-iron 11, a chassis 12, a magnet 13, and a pole plate 14. The deadening phase plug 2 is mounted on the chassis 12, with a gap 10 being defined between the T-iron 11 and the magnet 13 as well as the pole plate 14. The deadening phase plug 2 has a distal end that tapers to a conic, bullet-head, or arcuate shape. The deadening phase plug 2 is made of sound-absorbing cotton or wool felt by compression.

The frame 4 is annularly mounted to the pole plate 14. The cone 3 is fixed to the frame 4 by a supporting member 31. Thus, the cone 3 is suspended on an inner side of the frame 4. The cone 3 includes a central hole 32, and the voice coil 6 is mounted to an inner periphery delimiting the central hole 32 of the cone 3.

The damper 5 is located between the cone 3 and the pole plate 14 and connected between the voice coil 6 and the frame 4. Thus, the voice coil 6 is suspended in the gap 10. The damper 5 maintains vibrational balance of the voice coil 6.

Figure 2:
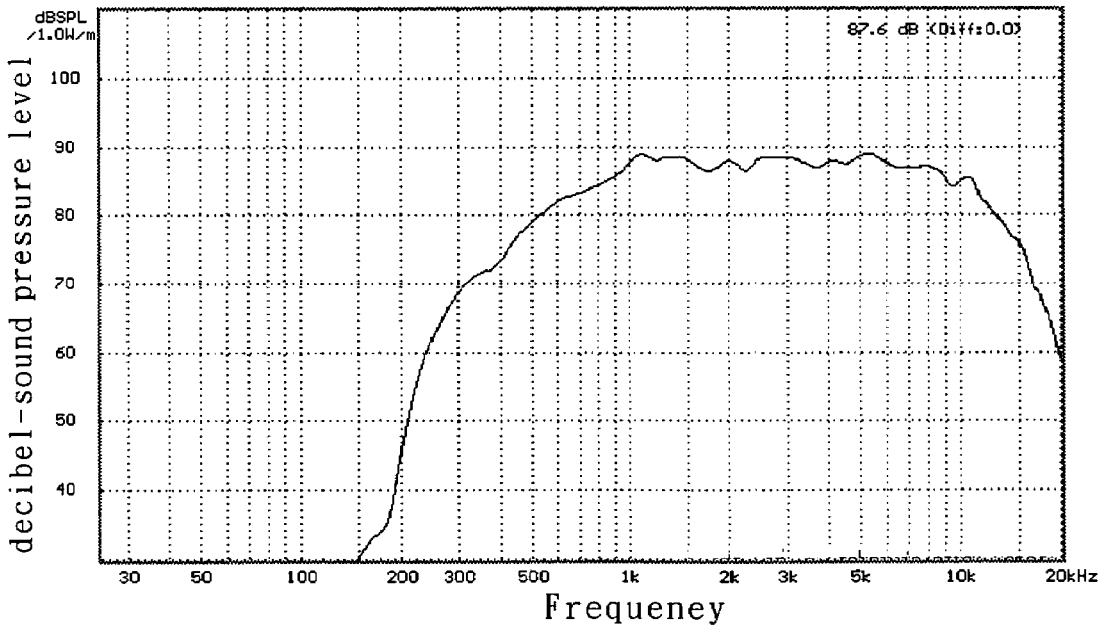
FIG. 2 is a frequency response diagram of the midrange in FIG. 1.

Referring to FIG. 2, the deadening phase plug 2 is made of a sound-absorbing material and thus performs an improved sound-absorbing effect. When the vibrational energy generated by the voice coil 6 is transmitted to the cone 3, the vibrational energy is transformed by the cone 3 into sound waves that are emitted outward. As can be seen from FIG. 2, the sound-absorbing material of the deadening phase plug 2 effectively absorbs and eliminates mutual interference of sound waves as well as suppresses chaos in the mid/high range frequencies of sound waves. The deficiency in the sound quality is reduced, and the vibrational characteristics in the mid/high range frequencies of sound waves are improved.

Figure 3:
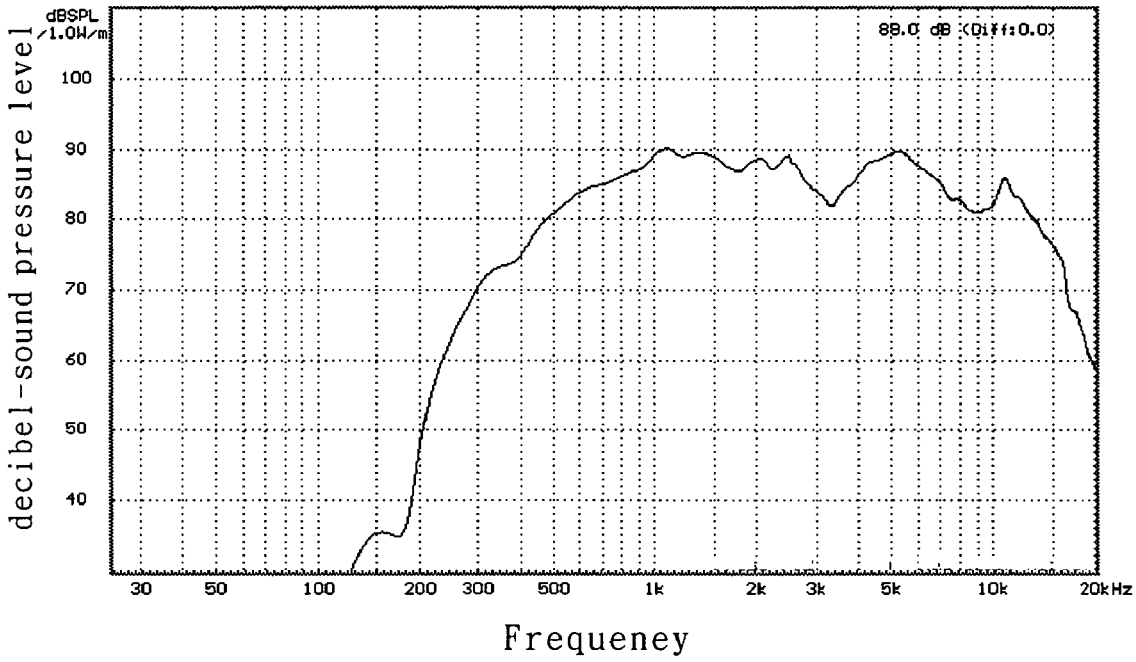
FIG. 3 PRIOR ART
FIG. 3 is a frequency response diagram of a midrange similar to the tweeter in FIG. 1, wherein the tweeter uses a phase plug made of a conventional material.

Referring to FIG. 3, in a case that the deadening phase plug 2 is made of a conventional material (such as metal or plastic material) performing a low sound-absorbing effect, the mutual interference of sound waves could not be effectively minimized, particularly in the frequency range of 1 kHz-20 kHz (the mid/high range frequencies of sound waves). The sound quality has deficiency due to mutual interference of sound waves.

Figure 4:
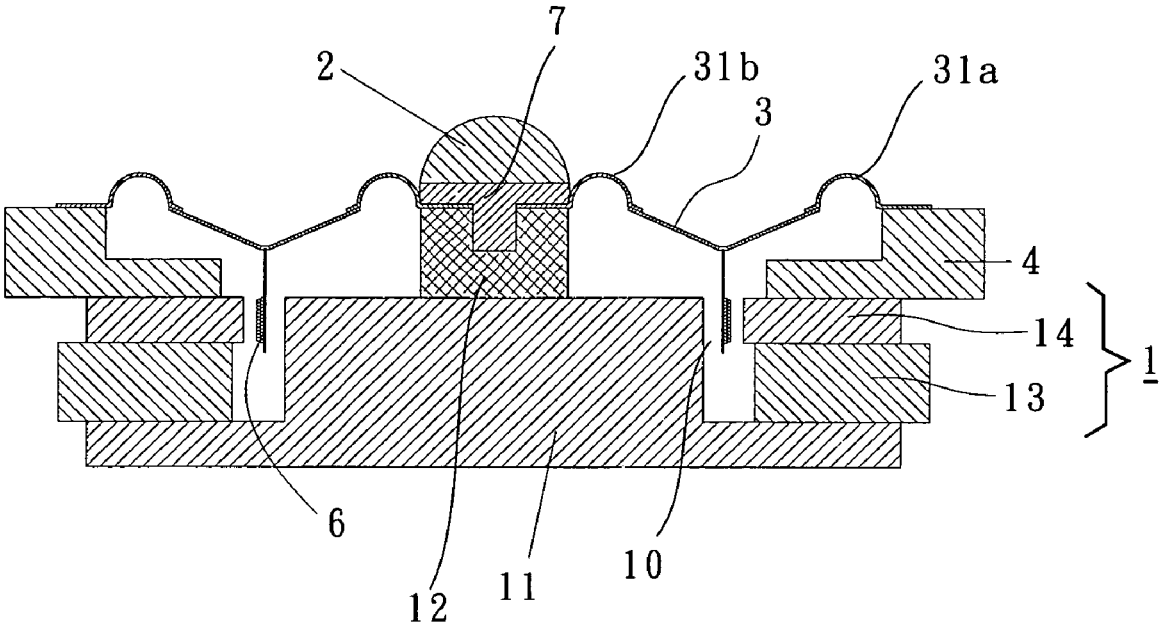
FIG. 4 is a sectional view of a second embodiment of a tweeter device for improving high range frequencies in accordance with the present invention.

FIG. 4 shows a second embodiment of the tweeter device for improving high range frequencies in accordance with the present invention. In this embodiment, the tweeter device comprises a magnetic base 1, a deadening phase plug 2, a cone 3, a frame 4, a voice coil 6, and a connecting member 7. Similar to the first embodiment, the deadening phase plug 2 is made of sound-absorbing cotton or wool felt by compression. Further, the deadening phase plug 2 is mounted on the connecting member 7 that is mounted on the chassis 12 of the T-iron 11 of the magnetic base 1. An outer side of the cone 3 is fixed to the frame 4 by an outer annular supporting member 31*a*. Further, the tweeter device includes an inner annular supporting member 31*b* having an outer end fixed to an inner side of the cone 3. The inner annular supporting member 31*b* further has an inner end sandwiched between the chassis 12 and the connecting member 7. The voice coil 6 is mounted to a bottom of the cone 3 at an appropriate position and suspended in the gap 10.

Figure 5:
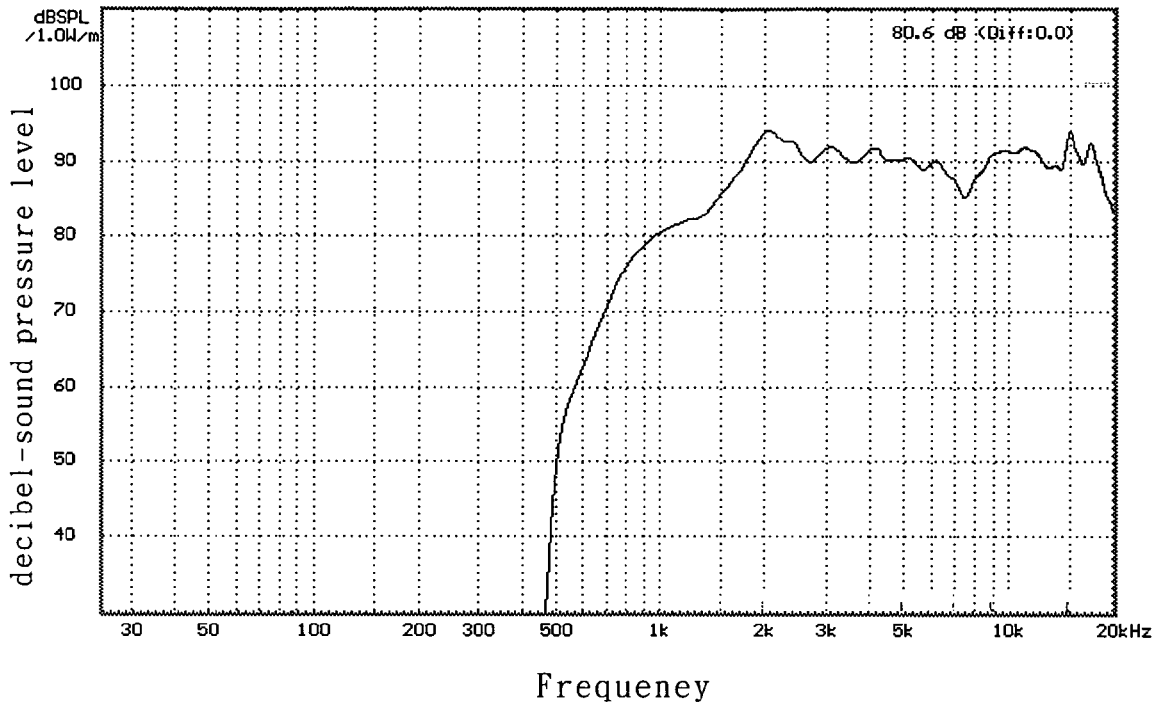
FIG. 5 is a frequency response diagram of the tweeter device in FIG. 4.

Referring to FIG. 5, the deadening phase plug 2 is made of a sound-absorbing material and thus performs an improved sound-absorbing effect. As can be seen from FIG. 5, the sound-absorbing material of the deadening phase plug 2 effectively absorbs and eliminates mutual interference of sound waves as well as suppresses chaos in the mid/high range frequencies of sound waves. The deficiency in the sound quality is reduced, and the vibrational characteristics in the mid/high range frequencies of sound waves are improved.

Figure 6:
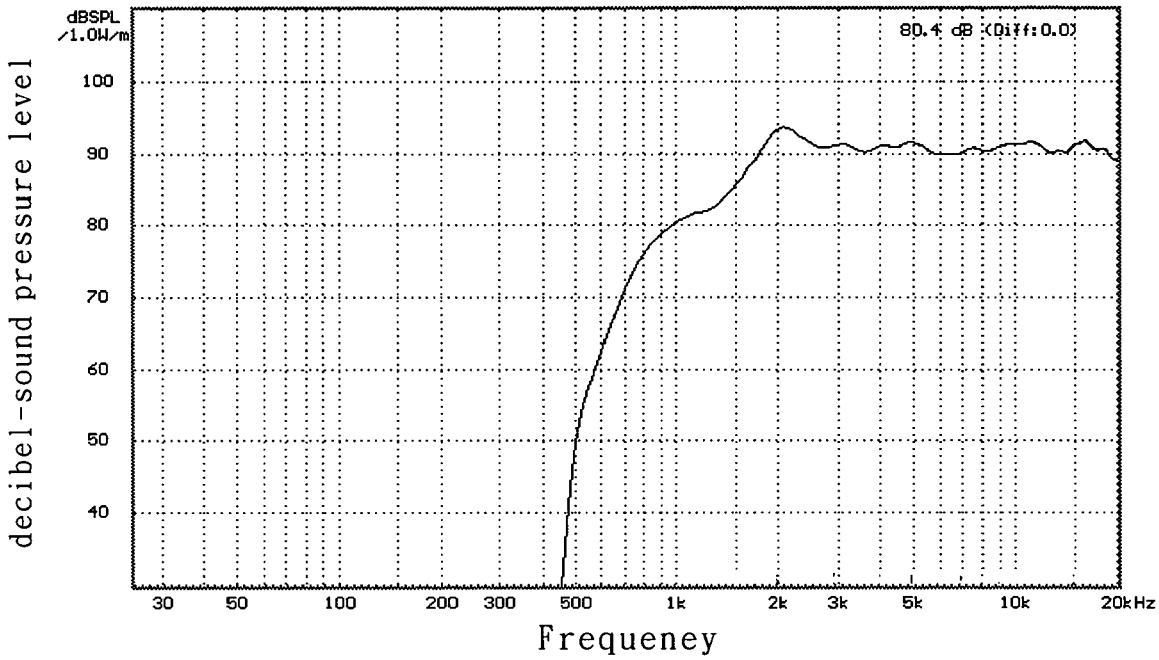
FIG. 6 PRIOR ART
FIG. 6 is a frequency response diagram of a tweeter device similar to that in FIG. 4, wherein the tweeter device uses a phase plug made of a conventional material.

Referring to FIG. 6, in a case that the deadening phase plug 2 is made of a conventional material (such as metal or plastic material) performing a low sound-absorbing effect, the mutual interference of sound waves could not be effectively minimized, particularly in the frequency range of 1 kHz-20 kHz (the mid/high range frequencies of sound waves). The sound quality has deficiency due to mutual interference of sound waves.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A speaker device for mid/high-range frequencies, comprising:

a magnetic base comprising:

a T-iron, a magnet, and a pole plate, the magnetic base further comprising a gap;

a frame annularly mounted to the magnetic base;

a cone mounted to an inner side of the frame;

a voice coil mounted to the cone and suspended in the gap of the magnetic base; and a deadening phase plug mounted on a central portion of the magnetic base, the deadening phase plug being made of a sound-absorbing material for absorbing and eliminating sound waves generated by the voice coil and the cone, wherein the T-iron includes a chassis on the central portion, the gap being defined between the T-iron and the magnet as well as the pole plate, the deadening phase plug being mounted on the chassis;

a connecting member mounted on the chassis, the deadening phase plug being mounted on the connecting member;

an outer annular supporting member for connecting an outer side of the cone to the frame; and an inner annular supporting member having an outer end fixed to an inner side of the cone and an inner end sandwiched between the chassis and the connecting member.

2. The speaker device as claimed in claim 1, wherein the deadening phase plug comprises a distal end that tapers to one of a conic shape, a bullet-head shape, and an arcuate shape.

3. The speaker device as claimed in claim 1, wherein the sound-absorbing material is one of sound-absorbing cotton and wool felt.

4. The speaker device as claimed in claim 1, further comprising a supporting member for connecting the cone to the frame, the cone including a central hole, the voice coil being mounted to an inner periphery delimiting the central hole of the cone.

5. The speaker device as claimed in claim 1, further comprising a damper mounted between the voice coil and the frame for maintaining vibrational balance of the voice coil.

* * * * *